US005308080A

United States Patent [19]

Lamle

[11] Patent Number: 5,308,080

[45] Date of Patent: May 3, 1994

[54] METHOD OF PLAYING A BOARD GAME

[76] Inventor: Stewart M. Lamle, 230 Fifth Ave., Suite 809, New York, N.Y. 10001

[21] Appl. No.: 826,267

[22] Filed: Jan. 24, 1992

Related U.S. Application Data

[63] Continuation of Ser. No. 631,665, Dec. 21, 1990, abandoned.

[51] Int. Cl.[5] ..... A63F 3/02; B65D 33/28

[52] U.S. Cl. ..... 273/264; 273/286; 383/4; 383/74

[58] Field of Search ..... 273/264, 271, 242, 260, 273/263, 285-287; 383/74, 72, 4

[56] References Cited

U.S. PATENT DOCUMENTS

| | | | |
|---|---|---|---|
| 1,269,276 | 6/1918 | Harris | 273/286 |
| 1,467,690 | 9/1923 | Schwarz | 273/286 |
| 2,667,353 | 1/1954 | Lanice | 273/286 |
| 3,460,834 | 8/1969 | Nickel | 273/264 |
| 4,456,261 | 6/1984 | Daitzman | 273/271 |
| 4,620,709 | 11/1986 | Palladino | 273/271 |
| 4,700,951 | 10/1987 | Lachenmeier et al. | 273/264 |
| 4,991,978 | 2/1991 | Ostrowski | 383/4 |

OTHER PUBLICATIONS

Better Homes and Gardens advertisement, "Fun in the Sun", Jun. 1971, p. 120, Bradford's, Inc.

*Primary Examiner*—Benjamin H. Layno

[57] ABSTRACT

A game apparatus includes fourteen playing places and a playing surface divided into sixteen squares. The players try to arrange their own pieces and two wild pieces into a winning configuration of four in a row, the four corner squares of the playing surface, or four adjacent squares which form a solid square. The playing surface may be formed into a pouch to contain the playing pieces.

8 Claims, 2 Drawing Sheets

METHOD OF PLAYING A BOARD GAME

This is a continuation of copending application(s) Ser. No. 07/631,665 filed on Dec. 21, 1990 now abandoned.

BACKGROUND OF THE INVENTION

The game of Tic-Tac-Toe is well known to all game players. Tic-Tac-Toe is called "Naughts & Crosses" in England, "Luk Tust K'i" in China, and "Achi" in Africa and has been played for thousands of years. The oldest board for playing the game was found in the ancient Egyptian Temple of Kurna dating from 1400 B.C.

The game of Tic-Tac-Toe has wide appeal since it is easily learned and quickly played without complicated rules or apparatus. Unfortunately, a game of Tic-Tac-Toe often ends in a tie when the two players fill the available squares of the playing surface before one player has achieved a winning configuration. The tendency of the Tic-Tac-Toe game to end in a tie removes some of the excitement from the game and causes the game to be less than satisfying.

It would therefore be desirable to devise a game which combines the ease of play of Tic-Tac-Toe without the drawback of a game which often ends in a tie.

SUMMARY AND OBJECTS OF THE INVENTION

According to the invention, a game apparatus for two players comprises fourteen playing pieces and a playing surface divided into a grid of sixteen squares. Each player is assigned six of the pieces and two pieces are wild and may be used by either player The players in turn place pieces on the grid and attempt to arrange the pieces in a winning configuration. Because two of the playing squares are always unoccupied, the players continue to move after all of the pieces have been placed on the grid until one of the players achieves a winning configuration.

It is thus an object of the invention to provide a game for two players using fourteen playing pieces and a playing surface which is divided into sixteen squares.

It is another object of the invention to provide a game apparatus in which two players maneuver fourteen pieces on a playing surface having sixteen playing squares until one of the players arranges his pieces in a winning configuration These and other objects of the invention will become apparent from the following detailed description in which reference numerals used throughout the description correspond to those found on the drawing figures.

DESCRIPTION OF THE PREFERRED EMBODIMENT

Figure 1:
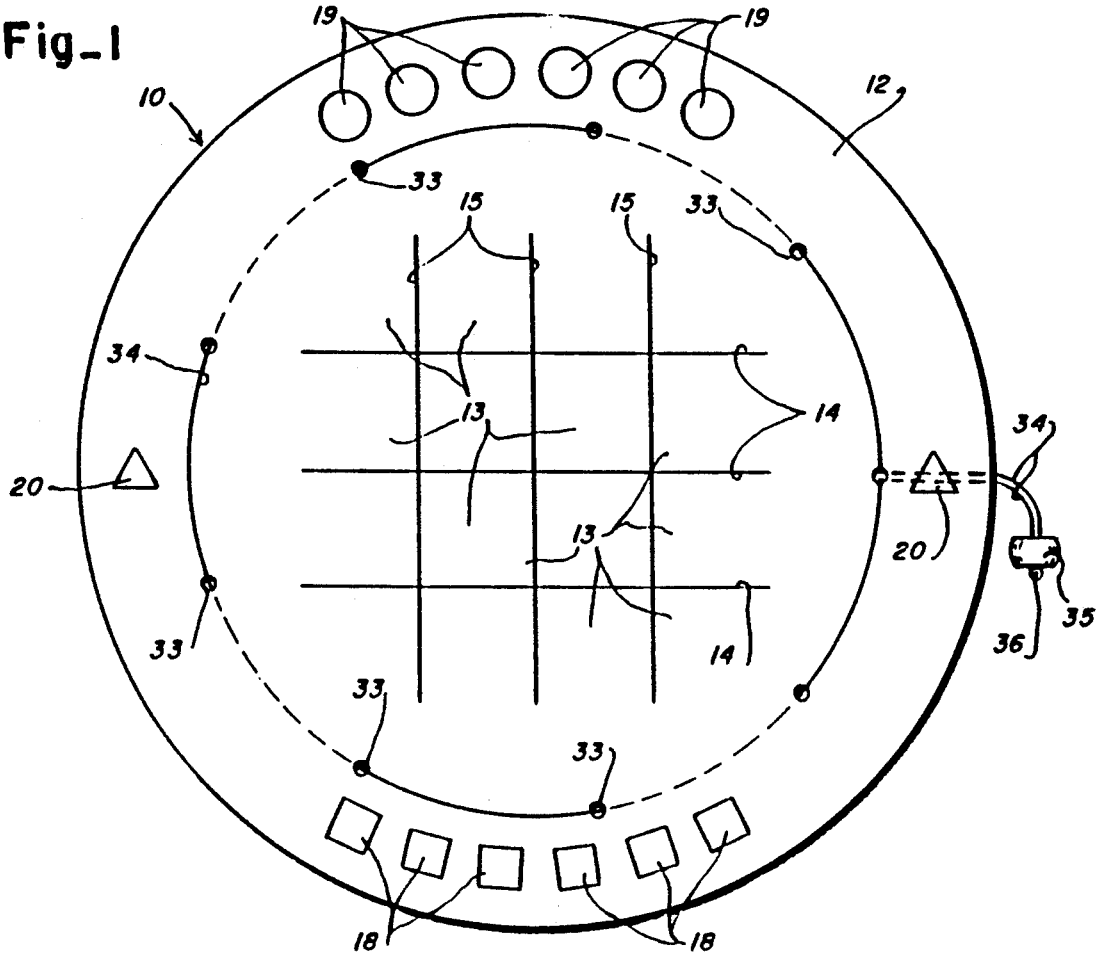
FIG. 1 shows the game apparatus of the invention.

Turning now to FIG. 1, the game apparatus is generally shown by the reference numeral 10. A playing surface 12 is divided into a grid of sixteen playing squares 13 by three horizontal lines 14 and three vertical lines 15. The game apparatus also comprises six round playing pieces 19, six square playing pieces 18, and two triangular playing pieces 20. For game play, one player uses the round playing pieces 19, and the other player uses the square playing pieces 18. The triangular playing pieces 20 are considered wild and may be used by either player.

Figure 2:
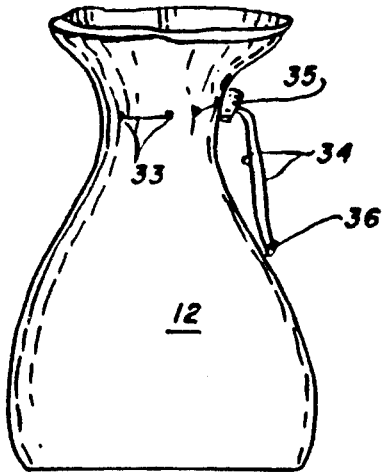
FIG. 2 shows the playing surface of the game apparatus formed into a pouch to hold the game pieces.

In actual practice, the playing surface 12 may comprise a cloth on which the horizontal and vertical lines 14 and 15 are printed. The cloth may include a number of eyelets 33 which receive a cord 34 which is looped around the perimeter of the playing surface 12. The ends of the cord pass through a bead 35, and a knot 36 retains the bead on the cord. A holder for storing the playing pieces 18, 19, and 20 can be formed by placing the pieces in the center of the cloth and pulling the cord ends causing the cloth to gather and form a pouch as shown in FIG. 2. Sliding the bead 35 along the free end of the cord 34 to the neck of the pouch holds the pouch closed and secures the pieces within.

METHOD OF USE OF THE PREFERRED EMBODIMENT

In order to play the game of the instant invention, the playing surface 12 as shown in FIG. 1 is placed between the two players with the round playing pieces 19 located off of the playing squares 13 in a location which is convenient to one player, the square playing pieces 18 located off of the playing squares 13 in a location which is convenient to the other player, and the triangular playing pieces 20 located off of the playing squares 13 in a location which is convenient to both players. According to the rules of the game, each player can use the six playing pieces which are assigned to him during game play as well as the two wild pieces 20. The players take turns placing either their own playing pieces or the wild playing pieces on the game board one at a time. The object of the game is for each player to place pieces on the playing squares 13 in a pattern of four in a row either horizontally, vertically, or diagonally, or on the four outside corners of the game board, or on four adjacent squares of the game board to form a solid square.

Figure 3:
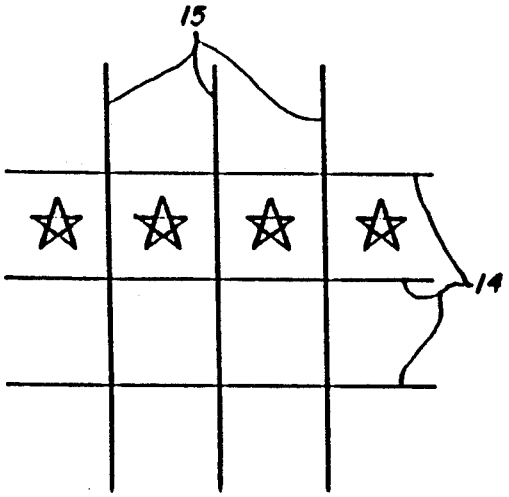
FIGS. 3–7 show various winning configurations for the playing pieces.
Figure 4:
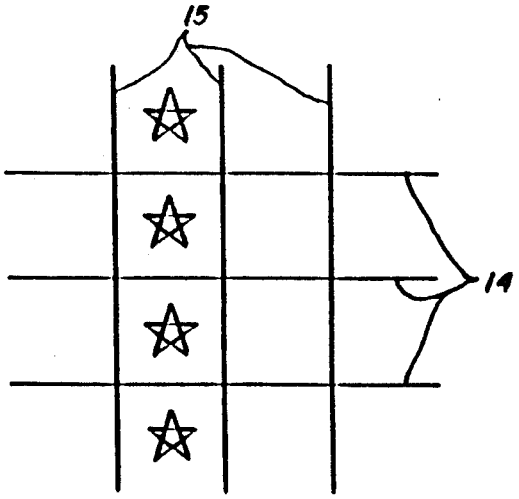
Figure 5:
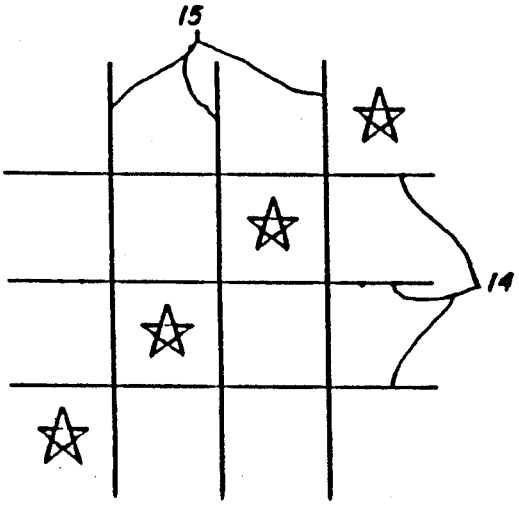
Figure 6:
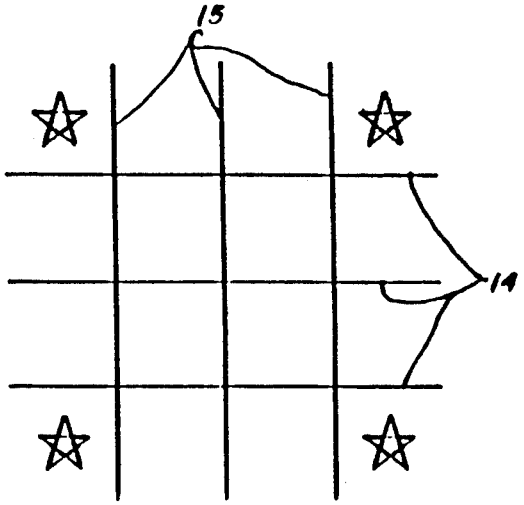
Figure 7:
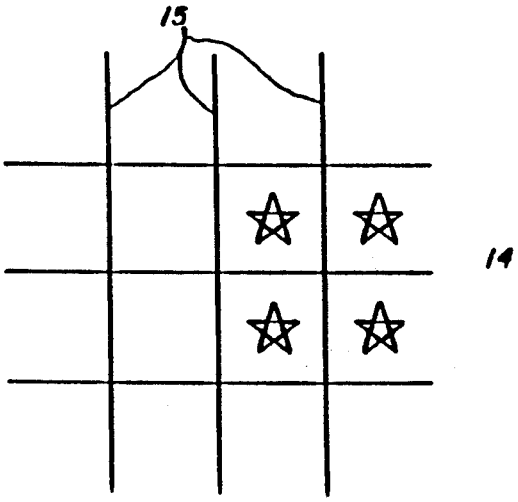

FIG. 3 shows four squares in a horizontal row, FIG. 4 shows four squares in a vertical row, and FIG. 5 shows four squares in a diagonal row. FIG. 6 shows the four outside corners of the game board, and FIG. 7 shows four adjacent squares which form a solid square. It will be understood that FIG. 6 shows the only possible configuration of the four outside corners but that FIGS. 3, 4, 5, and 7 are only exemplary of horizontal, vertical, diagonal and solid square winning configurations.

During game play, the two players alternate turns making one of the following moves: a place, a slide, or a jump. In a place move, a player places his own piece or wild piece onto any unoccupied square on the playing surface. In a slide move, the player slides his own piece or a wild piece which is already on the board to an adjacent unoccupied square; a slide may be made in a horizontal, vertical, or diagonal direction. In a jump move, a player jumps his own piece or wild piece over a single piece already on the board to land in the next unoccupied square; a jump move is made in a horizontal, vertical, or diagonal direction; a player may jump his own piece, his opponent's piece, or a wild piece. Jump and slide moves may be made both before and after all of the pieces have been placed onto the board. Players may only move their own piece or wild piece; a player may not move an opponent's piece. Only one piece can occupy a square at a time.

Since the board is divided into sixteen squares, and each player has six pieces and there are two wild pieces, there will always be two unoccupied squares on the board. After all the pieces have been placed on the board, the players slide and jump the pieces until one of the players wins.

Figure 8:
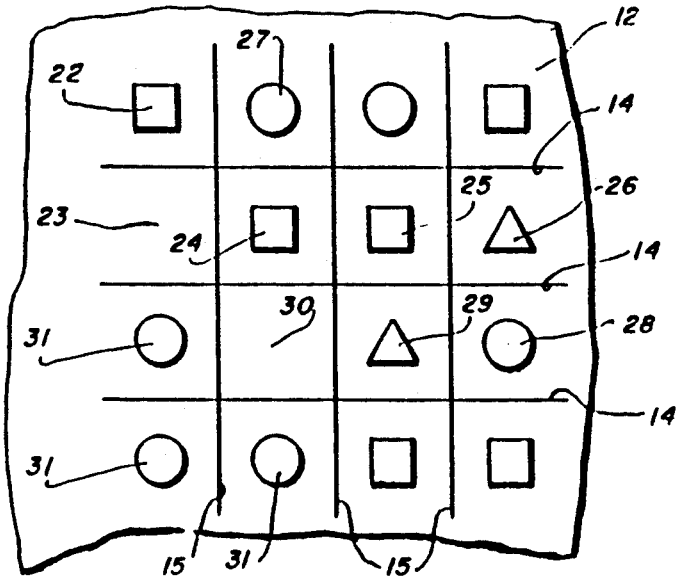
FIG. 8 shows the playing pieces arranged on the board during game play.

FIG. 8 shows the game apparatus during game play. No player has achieved four in a row, the outside corners, or a solid square configuration. If on the next move the square playing piece 22 is moved to the square 23, a horizontal row will be formed comprising the three square playing pieces 23, 24, and 25, and the wild piece 26. Alternatively, if on the next move the round playing piece 28 jumps over the wild piece 29 to the unoccupied square 30, a solid square will be formed comprising the round piece 28 and the three round pieces 31. The player with the round pieces may also win by moving the wild piece 29 to square 30 to form a solid square, or by jumping piece 27 to square 30 to form a solid square.

The following additional rules govern game play. A player may not move a wild piece if the same player has moved a wild piece as his last move. A player may not repeat a move in response to a repeat move by the other player. For example, if player one moves from A to B and player two moves from C to D, then player one moves from B to A and player two moves from D to C, and player one repeats the move from A to B, player two cannot repeat the move from C to D. This rule prevents a stalemate in which the players each move a single piece back and forth between the same two sets of squares.

Either player may call "one minute" at any time; this gives the other player only one more minute to make a move or the player who calls "one minute" can remove any one of the other player's pieces from the board and return it to its starting location, and the player who called "one minute" makes the next move.

In order to win, a player must correctly call "four in a row", "square", or "corners", even though the player who makes this call has not placed the pieces in the named configuration. Thus, a player who accidentally makes four in a row, a square, or the four corners for the other player loses if the other player calls the configuration.

If a player's move results in a win for both players, the player who has executed the move wins the game if that player calls the winning configuration before the move is completed. If the player making the move does not so call the winning configuration, the other player may call it and win the game. This can occur since the wild pieces may be counted by either player.

Those skilled in the art will recognize that the playing pieces may take other shapes, or may all be the same shape and designated as a player's pieces or wild pieces by different colors, sizes, or other distinguishing characteristics. Similarily, the playing surface may be formed on leather or other flexible material; and the bead which secures the cord may be replaced by any slideable closure member or toggle which may optionally be provided with a spring loaded detent means for locking the closure member in a desired position on the cord.

Having thus described the invention, various alterations and modifications will occur to those skilled in the art, which alterations and modifications are intended to be within the scope of the present invention as defined by the appended claims.

What I claimed is:

1. A method of playing a game with a plurality of playing pieces and a game board having a plurality of adjacent squares comprising:

dividing the playing pieces into first, second, and third distinguishable sets;

assigning the first set to a first player;

assigning the second set to a second player;

allowing the first player to use only the pieces of the first and the third sets;

allowing the second player to use only the pieces of the second and third sets;

restricting the players to the placement of pieces only on unoccupied squares of the game board; and allowing the players to alternate turns until one of the players moves the pieces he is allowed to use into a winning configuration.

2. The method of claim 1 further comprising:

restricting the players to movement of pieces which are already on the game board to the horizontal, vertical, and diagonal directions.

3. The method of claim 1 further comprising:

restricting the total number of playing pieces to fourteen; and restricting the total number of playing squares to sixteen.

4. The method of claim 3 further comprising arranging the sixteen adjacent squares in a four-by-four grid.

5. The method of claim 1 further comprising:

restricting the number of playing pieces in the first set to six and in the second set to six.

6. The method of claim 5 wherein a winning configuration comprises four pieces which are allowed to be moved by one of the players arranged in a horizontal, vertical, or diagonal row.

7. The method of claim 5 wherein a winning configuration comprises four pieces which are allowed to be moved by one of the players arranged in the four corners of the playing board.

8. The method of claim 5 wherein a winning configuration comprises four pieces which are allowed to be moved by one of the players positioned in four adjacent squares which form a solid square on the playing board.

* * * * *